US007094124B1

(12) United States Patent
Rouse

(10) Patent No.: US 7,094,124 B1
(45) Date of Patent: Aug. 22, 2006

(54) ROUSE DISPLAY SYSTEMS

(76) Inventor: Graham Manly Rouse, 430 Queen St., Columbia, SC (US) 29205

( * ) Notice: Subject to any disclaimer, the term of this patent is extended or adjusted under 35 U.S.C. 154(b) by 80 days.

(21) Appl. No.: 10/326,888

(22) Filed: Dec. 19, 2002

Related U.S. Application Data

(63) Continuation-in-part of application No. 10/002,963, filed on Dec. 5, 2001, now abandoned, and a continuation-in-part of application No. 09/542,674, filed on Apr. 1, 2000, and a continuation-in-part of application No. 09/066,119, filed on Apr. 24, 1998, now Pat. No. 6,332,823.

(60) Provisional application No. 60/008,096, filed on Oct. 30, 1995, provisional application No. 60/341,928, filed on Dec. 19, 2001.

(51) Int. Cl.
*G09F 21/06* (2006.01)

(52) U.S. Cl. ..... 446/220; 40/212; 428/13

(58) Field of Classification Search ..... 446/220–226; 40/214, 212; 428/13, 14
See application file for complete search history.

(56) References Cited

U.S. PATENT DOCUMENTS

| | | | | |
|---|---|---|---|---|
| 1,642,022 | A * | 9/1927 | Groh | 40/212 |
| 2,470,990 | A * | 5/1949 | Kennedy | 156/145 |
| 3,676,276 | A * | 7/1972 | Hirshen et al. | 446/220 |
| 4,179,832 | A * | 12/1979 | Lemelson | 40/540 |
| 4,850,926 | A * | 7/1989 | Lovik | 446/222 |
| 5,023,118 | A * | 6/1991 | Cheng | 446/221 |
| 5,533,285 | A * | 7/1996 | Skistimas et al. | 40/584 |
| 5,740,756 | A * | 4/1998 | Ord | 116/173 |
| 5,769,685 | A * | 6/1998 | Nakamura et al. | 446/221 |
| 6,019,660 | A * | 2/2000 | Luciano | 446/220 |
| 6,655,057 | B1 * | 12/2003 | Kim | 40/212 |

* cited by examiner

*Primary Examiner*—John A. Ricci

(57) ABSTRACT

A balloon display generally having decorative, informative and/or structural value. The display is comprised of an aperture framework, inflated chambers and connector members that join inflated chambers through apertures small enough to resist the passage of the inflated chambers. There is generally a plurality of connector members associated with each inflated chamber. Connector members from a given inflated chamber start from different locations, go to different locations and do not intersect.

14 Claims, 4 Drawing Sheets

ROUSE DISPLAY SYSTEMS

CROSS-REFERENCE TO RELATED APPLICATIONS

This application is a continuation in part of two applications by this inventor. They are application Ser. No. 10/002,963 titled "Continuous Balloon Structures" (CBS) filed Dec. 5, 2001 now abandoned which is incorporated by reference in its entirety and application Ser. No. 09/542,674 titled "Advanced Aperture Framework Balloon Display" (AAD) filed Apr. 1, 2000 which is incorporated by reference in its entirety. The CBS application is a continuation in part application of application Ser. No. 09/066,119 titled "Balloon Displays" (BD) filed in the United States Apr. 24, 1998 and issued Dec. 25, 2001 as U.S. Pat. No. 6,332,823 which is incorporated by reference in its entirety. The BD application claimed the benefit and priority date of U.S. Provisional Application Ser. No. 60/008,096, filed Oct. 30, 1995. The current application claims the benefit and priority date of U.S. Provisional Application Ser. No. 60/008,096, filed Oct. 30, 1995. The current application also claims benefit and priority date of provisional application No. 60/341,928 titled "Balloon Display Systems" (BDS) filed Dec. 19, 2001.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The field deals generally with balloons and their use for decorative, informative and structural values. The field is discussed in more detail in the referenced prior applications.

2. Description of the Related Art

Considerable prior art is discussed at length in the referenced prior applications.

There are a variety of needs in the balloon décor industry that remain unfilled. The current application addresses many of those in this application. Those solutions have implications for displays of other objects and media with decorative, informative and/or structural value. The current application addresses many of those implications as well.

a) A dominate issue in constructing balloon displays is their practical lifetime. Most displays made with latex balloons are limited to a few days. This is certainly true with helium filled latex balloons, even when treated with "Hi-Float". This patented chemical greatly enhances the float time of helium filled balloons, but still gives only a few days of practical life to normal sized balloons. Air filled balloons last longer than helium filled latex balloons but a longer life would be a great advantage for many displays. This application discloses a practical solution for many such displays.

b) Exploding balloons walls are a dramatic special effect, but the normal method of constructing such a display and exploding the balloons is difficult and risky. Most often the large latex balloons in such a display are glued together and then individually wired with a detonating device. If something happens to one of the balloons to explode it prematurely, that explosion will usually set off adjacent balloons as well. Also, it would be considerably more efficient if wiring layouts were reusable. This application discloses a practical solution for many such displays c) Graphic balloon displays are popular, but their remains a need to make the displays more precise, more detailed and last longer. This application discloses a solution that is distinct from, but may be used with the "longer life" solution suggested under a) immediately above.

d) The Over Lapping Cut Expandable Matrix (OCEM) discussed elsewhere in the referenced applications offer great advantages over more traditional forms of balloon framing for displays. Further economy of means and versatility in creating an expandable framework would be helpful. This application discloses solutions.

e) The current OCEM framework normally depends on the balloons to give some stiffness to the display of balloons and Matrix. It would be helpful to have a convenient way to add reinforcement and shape to the display so that the reinforcement is generally hidden. This application discloses solutions.

f) The current popular way of joining balloons and OCEM framework work well, but an easier system of joining the two would be a distinct advantage. This application discloses solutions.

g) The continuous balloon structures discussed elsewhere offer a variety of advantages over other balloon displays. One of those advantages is the ease with which the larger, "flat" side of film balloons may be set to face the spectators. There is a need to get this same "facing" advantage in displays of balloon garlands and clusters. This application discloses solutions.

h) Multiple film layers and multiple layers of inflatable chambers have been disclosed earlier in the referenced applications on Continuous Balloon Structures. There are ways to make more use of this technology than discussed in the formal application. These CBS balloons with multiple layers may be constructed so that by varying the sequence and relative volume of inflation in various sets of chambers, the overall shape of the display may be controlled and changed.

A. Density Enhanced Balloon Displays

One of the pervasive problems of balloon displays is keeping the balloons inflated. Gases normally used to inflate balloons such as air, nitrogen and helium leak out through latex balloons in a matter of hours or days. Even film balloons leak, though they do last much longer.

Some displays utilize fans to replenish leaking gas and maintain pressure especially in film balloons. It is common practice with latex balloons to coat the inside of the balloons with a liquid which drys to form an extra layer of material resistant to leakage of gases.

This invention discloses the use of a variety of density enhancing materials and methods for the filler within balloons and the association of these materials and methods with frameworks for the finished balloon display. This not only extends the useful life of the balloons but makes possible new uses as well.

B. LEM Layered Expandable Matrix

The Overlapping Cut Expandable Matrix first disclosed in the "Balloon Displays" application by Rouse provides a very efficient way to produce an expandable aperture framework from a thin sheet of material. Before expansion, however, the sheet will have a width approximately equal to the total of the widths of individual straps crossed by a line perpendicular to the length of the sheet. If there are, for example, 20 straps forming apertures in one cross section of the framework and each strap is one inch wide, then the total width of the framework before expansion will be approximately 20 inches. It would be desirable to have a smaller surface area occupied by the framework before expansion.

It is also often difficult to expand the OCEM without getting twists in some of the straps.

In one aspect, this invention discloses the joining of aperture straps in layers so that, for example 20 straps would be stacked rather than laid out side by side therefore requiring one inch of surface space rather than 20 inches and simultaneously reducing the risks of twisting.

C. Stretched Bubble Balloon Display

One of the difficulties to overcome, particularly with latex balloons, in balloon displays is the shrinkage of balloons over time as the gasses leak out. Such shrinkage can leave gaps in the display.

One system for dealing with this problem is to stretch a balloon over a framework. When properly done, the display area exhibited by the balloon remains relatively constant even as gas escapes from the balloon and the volume decreases. The balloon becomes flatter but retains a display area the size of the frame over which the balloon is stretched.

Current practice, however, is limited in scope, technique, materials, and systems for generating larger displays from individual units. This invention discloses a variety of materials, techniques and systems that advance the art for balloon displays incorporating stretched bubble technology.

D. Balloon Buttons for Balloon Displays

In the inventory of techniques for anchoring one balloon to a supporting framework is what I call the "button". In its most common usage one inflatable chamber is connected directly to a second inflatable chamber. Usually the inflation stem of one balloon is tied to the inflation stem of a second balloon. One balloon is forced through an aperture in a supporting framework. The second balloon remains on the starting side of the framework. As with a button, the aperture is configured to allow the button (balloon) through, but resist its return to the starting side. The flexibility of balloons, especially latex balloons, allows a broader range of shapes to pass through and still resist a return.

As with standard buttons, the current practice with balloon buttons is to have a single line or single area of connection between the button on one side and the object on the other side with the connection being generally centered on the button.

This invention advances the art of balloon displays with innovations in design and technique for balloon buttons.

E. FAT Matrix Framework and Transmission Matrix

The Overlapping Cut Expandable Matrix first disclosed in the "Balloon Displays" application by Rouse provides a very efficient way to produce an expandable aperture framework. The main emphasis of the initial application was for such a framework to be used in support of balloons for display. A variety of other uses were also suggested. This invention discloses uses of the OCEM as framework and transmission device.

There are many conditions under which there is a need to distribute and/or display gases, liquids, solids, electricity, light, data, information and other useful content to locations in a predetermined array. In many of those situations it would be useful to manufacture the delivery device in compact form and then have it readily expandable upon arrival to the appropriate location. The Rouse overlapping cut, expandable matrix is appropriate and useful under many such conditions. It may serve as framework supporting the delivery device or may be especially formed to become the delivery device.

F. Structural Aperture System

Currently, there are two commercially available, flexible, aperture framework systems for balloon displays. One is the overlapping cut expandable matrix known as the Rouse Matrix Systems (RMS) and the "soft" SDS (Skistimas Design System). The soft SDS is basically a foam sheet with die cut holes to hold balloons. The foam sheet is flexible. RMS frameworks are usually flexible sheets of plastic expanded into an array of apertures to hold balloons.

Neither of these frameworks has any built in system to add structural reinforcement for the creation and maintenance of three dimensional shapes made from sheets of balloons in these frameworks. This invention discloses innovations in framework design that make such systems both possible and practical.

BRIEF SUMMARY OF THE INVENTION

It will become apparent to the examiner as it is to the inventor that this disclosure contains more innovations than may reasonably be covered in one set of claims. It is also apparent that the innovations are related. They are kept together here to maintain their continuity, synergy, and support of the current patent claims. The current set of claims derives from disclosures found in the combination of all three Rouse applications referenced and contained herein. It is anticipated that future divisional and continuations in part applications will draw further on this combination of Rouse innovations.

There are a variety of technical and method innovations which, when combined with the earlier disclosures yield advantages for the creation of balloon displays. Some of these innovations can be useful independently of earlier disclosed technology. Some of the innovations have application outside of balloon displays as well.

A. Density Enhanced Balloon Displays

In order to create longer lasting balloon displays inflatable chambers may be filled with fluids, fluidized solids, and/or highly malleable materials under pressure. These materials may be as simple as water. Any such material that can substantially fill the volume of the inflatable chambers and is highly resistant to passing through the skin of the chamber can work. Even more advantages may be achieved by filling the inflatable chambers with material that will or can be converted to a more solid state after is has filled the chambers and the chambers have been positioned to effect the desired display, information and/or structure. Water may be frozen. Plaster, concrete and various caulking compounds set into more rigid forms. A variety of foams set into rigid plastics. Some foam sets into softer, sponge like shapes.

Using OCEM frameworks in conjunction with the inflatable chambers may extend the advantages of this approach. Using CBS balloons as the inflatable chambers may also extend the advantages. In addition, the MD forms of aperture frameworks may further add to the effective use of these extended life creations.

Ice sculptures done with small, clear bubbles and aperture frameworks will hold their shape much longer than normal balloons and much longer than normal ice sculptures as well. Larger scale, foam insulation filled structures in OCEM frameworks made of heavy duty plastic or metal, could create architecturally sound cores for habitable buildings or permanent outdoor art. The potential uses are quite numerous.

B. Layered Expandable Matrix Balloon Display

This invention discloses an expandable aperture framework comprised of layers of material, usually in strips. The layers are joined at intervals that are usually staggered from one layer to the next. The framework is used in conjunction with inflatable chambers to create displays.

This invention teaches the use of 1. framing elements of a variety of materials
2. non flat framing elements
1. translucent and transparent framing elements
2. framing elements which have apertures or are outlines rather than generally solid sheets
3. enhancements to the natural state of the framing elements in order to create a better hold between the framing element and the balloon including:
   a) adhesive coatings on the framing element and/or the balloon
   b) surface texturing of the framework
   c) surface texturing of the balloon
   d) bumps, protrusions, etc. to the framing element
   e) bumps, protrusions, etc. to the balloon
   f) sculpting of framing element to match particular inflatable chamber forms
   g) sculpting of inflatable chamber to framing element
4. clamps etc. to reinforce the hold of the balloon and framing element
5. assorted devices to hold the framing element to some larger structure
6. framing elements that are inflatable
7. connections between layers of material that include
   a) heat seals
   b) chemical bonds
   c) interlocking notches/holes
   d) magnets
   e) bolts
   f) rivets
   g) adhesive
   h) tieing
   i) clamping
   j) balloons tied through layers
   k) welding
   l) hinges
   m) stapling
10. diverse materials for framing elements including:
   a) paper
   b) natural fiber
   c) synthetic fiber
   d) plastic film
   e) metal
   f) nylon
   g) wood
   h) fabric
11. diverse materials for inflatable chambers including:
   a) latex
   b) nylon
   c) plastic
   d) vinyl
   e) fabric
12. diverse forms of inflatable chambers including:
   a) independent, single chamber inflatables
   b) directly connected, but independently inflatable chambers
   c) directly connected inflatable chambers with fluid communication between chambers
   d) multilayered inflatable chambers
13. methods of fixing the relative position of framework and inflatable chambers disclosed in other sections of this application
14. connections between layers so configured that they expand into patterns of openings including"
   a) squares
   b) diamonds
   c) triangles
   d) octagon-squares
   e) dome forms
   f) cubes
15. at least one cut within a section of one layer of framing material that may be pulled open to better hold at least one inflatable chamber
16. overlapping cuts within at least one section of one layer of framing material that may be expanded to better hold at least one inflatable chamber This form of expandable matrix is similar in underlying nature to the overlapping cut expandable matrix. Both frameworks start out with their framing elements generally nested side by side in generally parallel arrangement. Adjacent framing elements are connected at various points or areas along their adjacent sides or edges. Those connections are generally staggered from one row to the next.

The main distinguishing characteristic is that with the layered expandable matrix, adjacent framing elements are connected on their sides with the largest area. With the overlapping cut expandable matrix, adjacent framing elements are connected on their sides (edges) with the smallest surface area.

In both cases the frameworks expand generally perpendicular to the largest surfaces of the framing elements. With the layered matrix the larger surfaces are stacked and expand one directly above the other. With the overlapping cut matrix the largest surfaces are side by side and expand over a wider area.

Given a particular set of dimensions for open lengths and connected lengths and staggers between layers, either expandable matrix will give essentially the same design result when loaded with balloons.

C. Stretched Bubble Display

Here is one way to create precise, scalable balloon elements for balloon graphics.

A balloon display comprised of inflatable chambers each of which has been distorted from its natural inflated shape by stretching each inflatable chamber over an aperture framing element wherein each inflatable chamber is at least partially inflated and wherein each framing element remains outside the inflated volume of the inflated chamber.

A. The Normal Process.

(1) The length and width of the framing element is smaller than the inflated length and width of the inflatable chamber to wrap around the framing element (2) The inflatable chamber is inflated to a length and width greater than that of the framing element (3) The framing element is pressed against the inflatable chamber as the inflating gas is released from the inflatable chamber. The pressure applied is sufficient to force the outer perimeter of the framing element below the outer perimeter of the balloon. As the gas is further released the outer perimeter of the balloon shrinks back toward the center of the balloon and also toward the center of the framing element so that the outer perimeter of the balloon wraps around the perimeter of the framing element and over the back side of the framing element.

B. Standard Practice In The Trade (1) This practice is relatively uncommon but not unheard of in the trade (2) When it is used a. The framing element is a sheet of solid, flat material b. The framing element is opaque c. The framing element is forced into one side of the balloon d. The neck or valve section of the balloon is near one edge of the framing element e. The framing element is not enhanced to hold the balloon in place C. This Invention (1) Teaches the use of framing elements of a variety of materials (2) Teaches the use of non flat framing elements (3) Teaches the use of translucent and transparent framing elements (4) Teaches the use of framing elements which have apertures or are outlines rather than generally solid sheets with the placement of the inflation stem inside the frame surroundings (5) Teaches the use of enhancements to the natural state of the framing elements in order to create a better hold between the framing element and the balloon a. adhesive coatings on the framing element and or the balloon b. surface texturing of the framework c. surface texturing of the balloon d. bumps, protrusions, etc to the framing element e. bumps, protrusions, etc to the balloon (6) Teaches the use of clamps etc to reinforce the hold of the balloon and framing element a) Teaches the use of assorted devices to hold the framing element to some larger structure D. Balloon Buttons for Balloon Displays This invention is like a string of beads where at least one of the middle beads is forced through a button hole thereby anchoring the string of beads to the material around the button hole. The shortest such string in our invention is a single bead forced through the aperture with a connection from each end of the bead to an end of another bead on the other side of the aperture. The fewest beads in such an arrangement would be two. This would be a simple loop. Without a loop the fewest would be three. Whether two or three, all the beads or, in our case, inflated chambers would be sized and positioned to resist passing through the adjacent aperture.

"Inflated chambers" is used here instead of "balloons" because each of our two, three or more balloon beads would be a chamber that has been inflated but all of the chambers might be made from a single balloon. For instance, If a framework has a series of small apertures close together it would be possible to inflate a single long latex balloon and twist it into a series of inflated chambers very much like a string of beads. It is also possible to have a string of inflatable chambers with fluid communication among them manufactured by at least one die application to at plurality of layers of film. If the connection between adjacent chambers is narrow then this single balloon could also look and function much like a string of beads.

Once our first IC has been forced into place there are many developments and variations possible. Other IC's in the string may likewise be forced through adjacent apertures or some may be forced through apertures or centered in apertures while others are not. Loops comprised of two balloon beads may be joined into strings of their own. Multiple ICs may replace individual ICs in the role of single beads. Two connectors normally come from opposite ends of the balloon beads but more than two might be created. Since the connectors are normally broadly spaced on the balloon beads they normally pass through the adjacent aperture in broadly spaced positions. Since the balloons are flexible the connectors might be drawn together to pass through the aperture.

E. Framework And Transmission Matrix

OCEM (Overlapping Cut Expandable Matrix) frameworks are normally quite compact and lightweight when they are made; yet they expand easily into considerably larger structures. This offers the opportunity to attach electrical wiring or other transmission devices to the OCEM framework at the factory when it is easiest. The wiring then expands into its assigned place along with the framework at installation. In similar fashion, the OCEM may be collapsed and re-folded or rolled for storage after the event. The transmission device goes with the OCEM and is likewise ready for the next event.

In our example of an exploding balloon wall, there are other advantages as well. Adjacent balloons in the wall are not connected to each other, but to the framework. If one balloon explodes prematurely, only one balloon dies. And, it is easily replaced as the OCEM framework keeps the other balloons in place and the aperture open for a replacement balloon. Once the wall is exploded, only the disposable detonating device need be replaced.

The transmission device need not be limited to exploding balloons. The wiring might lead to lights. The array of lights would be very compact for assembly, shipping, storage, and display to potential customers. It would expand into a much larger display in a shape predetermined by the designer. Alternately, the transmission device might set off confetti cannons, fireworks. Etc.

Such electrical transmission might not require separate attachment of wiring. Many film balloons are coated with a metallic layer. The OCEM might be made into a giant, flexible and expandable "circuit board" by carefully controlling the application of metallic lines on the film.

Other sorts of transmission devices and media might be used as well. For instance, one balloon exploding system uses tubes to carry pneumatic pressure as a detonating system for balloons. Another system uses "shock tubing" to similar effect. The shock tubing is coated inside with gunpowder. When a pistol like device fires a blank into the tubing it sets off the gunpowder in a rapid chain reaction that generates hot gasses. The gases escape through especially placed apertures and pop the balloons.

Another option would be to make the OCEM hollow so that it might use that space as a transmitter in addition to serving as the framework for transmission. For instance, small holes might be strategically placed in the OCEM. The OCEM might then be stretched out and water run through it to water a lawn. Such an arrangement might provide distribution of air, liquid fertilizer, etc. The hollow OCEM might be sealed with gas inside and an electrical charge added to create a neon light.

Once this insight is added to our thinking many, many possibilities that were hidden suddenly become clear.

F. Structural Aperture System Balloon Display

This balloon display is comprised of a. a plurality of inflatable chambers, b. a framework that provides support for the plurality of inflatable chambers 1. The framework is semi-rigid or flexible.

2. The framework contains a plurality of major apertures.

a) The framing elements defining major apertures contain a plurality of minor apertures.

b) The plane of minor apertures is generally perpendicular to the plane of adjacent major apertures a) at least one structural element in addition to structural elements defining major apertures passes through a plurality of the minor apertures.

This arrangement allows for as many or as few structural elements to be added to the basic, non rigid aperture framework as desired. The added structure could be flexible such as monofilliment (fishing) line and help to form the overall structure through its tensile strength. The added structure could be more rigid than the basic aperture framework such as aluminum rod and be formative by bending the basic aperture framework to the shape of the more rigid added element.

This arrangement allows for the added structural elements to be generally centered within the plane of the overall framework and thereby to be generally hidden by inflatable chambers which are themselves generally centered within the plane of the overall framework. This system allows the designer to better control the form of the finished display than with normal flexible frameworks for lack of suitable formative structure. This system allows the designer to better control the form of the finished display with normal rigid frameworks for lack of necessary flexibility. This system allows for the addition of as much or as little additional structural support as necessary for a particular project in a way that is convenient and inconspicuous.

DETAILED DESCRIPTION OF THE INVENTION

A. Density Enhanced Balloon Displays

Separate illustrations for density enhanced balloon displays have not be added to the drawings. All the drawings and specifications that refer to inflatable chambers, partially inflated chambers, inflated chambers and the like are drawings and specifications that support definition of density enhanced balloon displays. The idea here is to use more dense media than normal gasses to substantially or completely carry out the partial or complete filling of the inflatable chambers as described elsewhere in the specifications and drawings.

This is not intended to claim "water balloons", for instance, independently of other innovations disclosed here. They have been around a long time. It is intended to positively disclose and claim density enhanced inflatable chambers in association with the wide range of support structures and display formation methods that are disclosed in this application.

To a large extent the use of terms such as "fluids" and "fluid communication" in the specifications rather than "air" or "gas" already encompass liquids, fluidized solids, and other more dense media that can be forced to "flow" like liquids under pressure. Density enhancement, however, has benefits that cross the boundaries of the various structures and methods previously disclosed. It also is more than substituting "flowable material" for "fluid".

We disclose and claim media that change state as well as media that remain the same upon entry into the inflatable chamber. This can be as simple as water that is later frozen. It can be as complex as a mixture of chemicals with a catalyst that react to heat, light, vibrations, x rays or a special inner coating within the inflatable chamber. It can be on a small scale as with a string of ½" diameter, water filled bubbles from a long skinny balloon for making a table top display. It can be on a grand scale with inflatable chambers measured by the yard and filled with concrete to produce a building.

B. Layered Expandable Matrix Balloon Display

Figure 9:
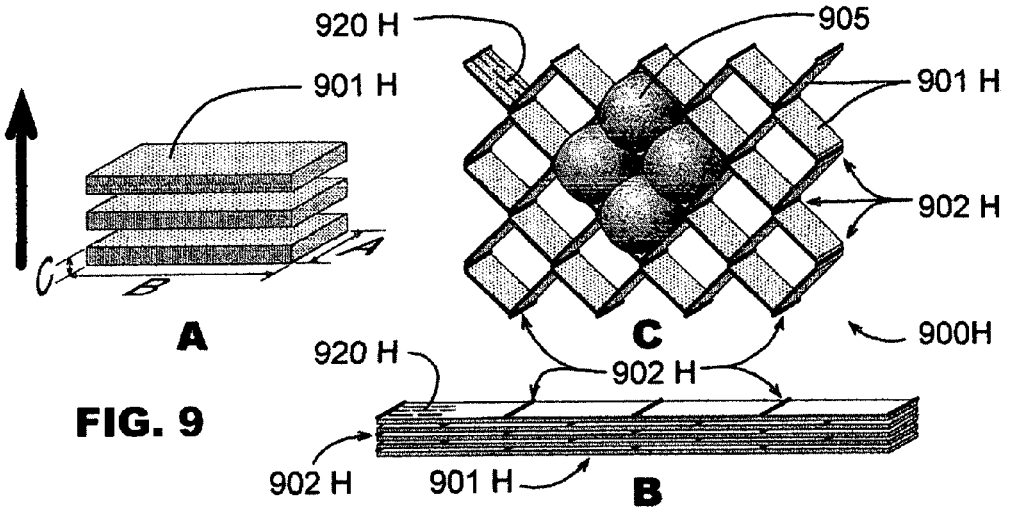
FIGS. 9A–C shows a perspective view of layers of material with staggered connections between layers where the area of the horizontal surfaces are significantly greater than the are of the vertical surfaces.

Referring now to FIG. 9, there is a layered expandable matrix balloon display 900 H. FIG. 9A illustrates that the layered matrix has framing elements 901 H in which the adjacent surfaces "A×B" are significantly larger than the edges "B×C". The resulting general direction of expansion of the matrix is perpendicular to the larger surfaces "A×B" as represented by the bold vertical arrow.

FIG. 9B shows the layered matrix before expansion and loading with inflatable chambers. Layers of framing elements 901 H are stacked. The layers of framing elements are connected by fastening means 902 H at staggered intervals between layers. One section of framing elements has several overlapping cuts 920 H. This miniature overlapping cut expandable matrix within the layered expandable matrix adds versatility and added control over the shape and color of the finished display. Small arrays of inflatable chambers or other items may be held by the small openings. This could provide important details in the finished display. It also provides means to shorten the length of that section of the framework by spreading apart that section of material.

FIG. 9C shows a perspective view of the expanded framework with inflatable chambers 905 installed. In this case the framework is configured to open into diamonds, but many variations of aperture patterns are possible. All of the patterns shown in the drawings related to the overlapping cut expandable matrix are possible with the layered matrix as well.

Figure 10:
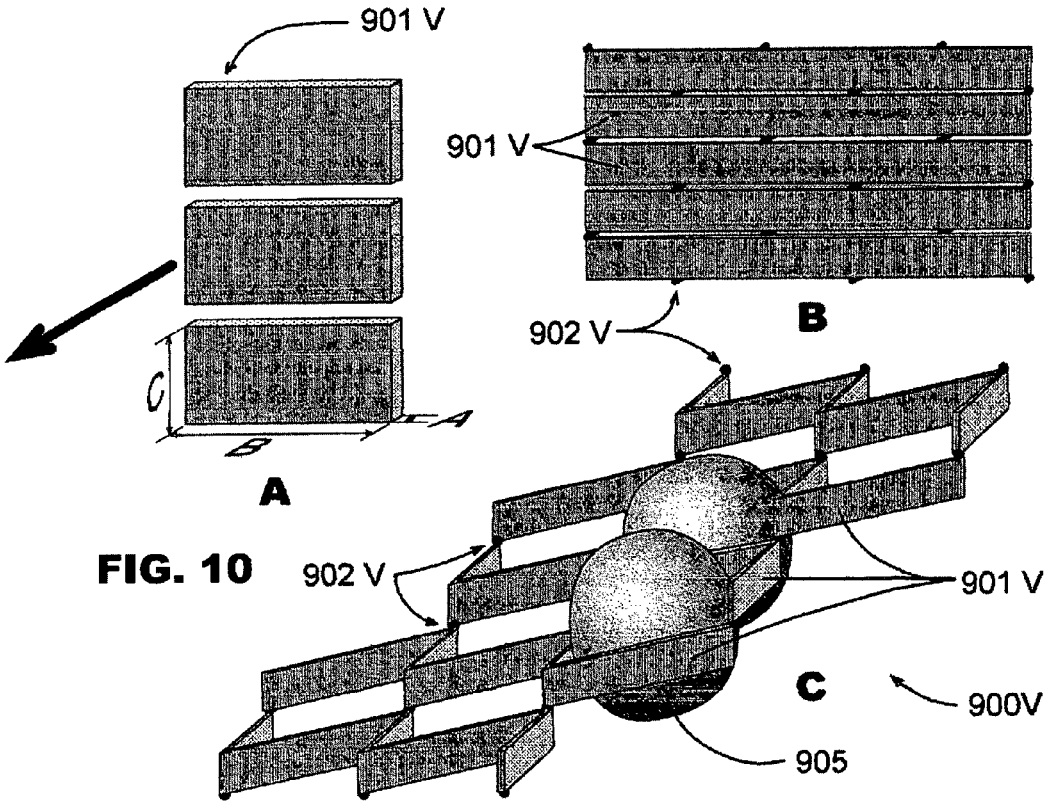
FIGS. 10A–C shows a perspective view of layers of material with staggered connections between layers where the area of the vertical surfaces are significantly greater than the are of the horizontal surfaces.

Referring now to FIG. 10, there is a layered expandable matrix balloon display 900 V. FIG. 10A illustrates that the layered matrix has framing elements 901 V in which the adjacent surfaces "A×B" are significantly smaller than the edges "B×C". The resulting general direction of expansion of the matrix is perpendicular to the larger surfaces "A×B" as represented by the bold diagonal arrow.

FIG. 10B shows the layered matrix before expansion and loading with inflatable chambers. Layers of framing elements 901 V are stacked on the narrow side. The layers of framing elements are connected by fastening means 902 V at staggered intervals between layers.

FIG. 10C shows a perspective view of the expanded framework with inflatable chambers 905 installed. In this case the framework is configured to open into diamonds, but many variations of aperture patterns are possible. All of the patterns shown in the drawings related to the overlapping cut expandable matrix are possible with this layered matrix as well. In fact, if you observe closely, this pattern of opening is the same as that of the overlapping cut expandable matrix.

C. Stretched Bubble Display

A balloon display comprised of inflatable chambers each of which has been distorted from its natural inflated shape by stretching each inflatable chamber over an aperture framing element wherein each inflatable chamber is at least partially inflated and wherein each framing element remains outside the inflated volume of the inflated chamber.

a. The Normal Process.

Figure 1:
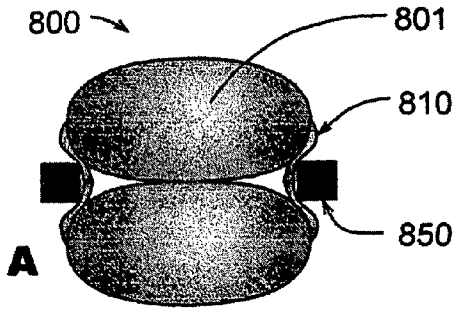
FIGS. 1A–B shows a section through an aperture framework with a pair of inflatable chambers connected through the aperture according to the present invention.

(1) The length and width of the framing element is smaller than the inflated length and width of the inflatable chamber to wrap around the framing element (2) The inflatable chamber is inflated to a length and width greater than that of the framing element (3) The framing element is pressed against the inflatable chamber as the inflating gas is released from the inflatable chamber. The pressure applied is sufficient to force the outer perimeter of the framing element below the outer perimeter of the balloon. As the gas is further released the outer perimeter of the balloon shrinks back toward the center of the balloon and also toward the center of the framing element so that the outer perimeter of the balloon wraps around the perimeter of the framing element and over the back side of the framing element.

b. Standard Practice In The Trade (1) This practice is relatively uncommon but not unheard of in the trade (2) When it is used (a) The framing element is a sheet of solid, flat material (b) The framing element is opaque (c) The framing element is forced into one side of the balloon (d) The neck or valve section of the balloon is near one edge of the framing element (e) The framing element is not enhanced to hold the balloon in place c. This Invention (1) Teaches the use of framing elements of a variety of materials (2) Teaches the use of non flat framing elements (3) Teaches the use of translucent and transparent framing elements (4) Teaches the use of framing elements which have apertures or are outlines rather than generally solid sheets with the placement of the inflation stem inside the frame surroundings (5) Teaches the use of enhancements to the natural state of the framing elements in order to create a better hold between the framing element and the balloon (a) adhesive coatings on the framing element and or the balloon (b) surface texturing of the framework (c) surface texturing of the balloon (d) bumps, protrusions, etc to the framing element (e) bumps, protrusions, etc to the balloon (6) Teaches the use of clamps etc to reinforce the hold of the balloon and framing element (7) Teaches the use of assorted devices to hold the framing element to some larger structure D. Balloon Buttons for Balloon Displays Referring now to FIG. 1, there is a balloon display using balloon buttons 800. FIG. 1A is a cross section of an aperture framework made with framing elements 850. A plurality of sets of inflatable chambers 801 are connected through the aperture by connector members 810. In this example the first set of inflatable chambers has its center of mass on the top side of the framework in the illustration. The first set is comprised of a single inflatable chamber as is the second set of inflatable chambers. The second set has its center of mass on the bottom side of the framework in the illustration. These sets could equally well be comprised of a plurality of inflatable chambers. There are two connectors between sets of inflatable chambers shown, but there might equally well be a greater number. The connectors are placed generally on the perimeter of the sets of inflatable chambers. The sets of inflatable chambers are of a size and shape to overlap the framing elements so as to resist passing through the aperture. The perimeter placement of the connectors serve to both connect the two sets of inflatable chambers and to assist in centering the sets in the aperture.

FIG. 1B shows a perspective view of his arrangement. The aperture framework 850 is illustrated here as a single aperture in a rectangular shape. It is anticipated that most such displays will involve a plurality of apertures. There is also no requirement that limits such displays to rectangular apertures. The apertures might be any shape that facilitates the end design of the display.

Figure 2:
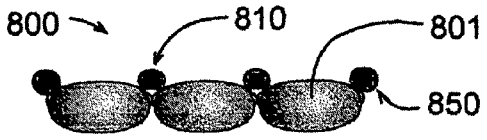
FIG. 2 shows a section through an aperture framework with three inflatable chambers connected through apertures according to one embodiment of the present invention.

Referring now to FIG. 2, there is another balloon display using balloon buttons 800. FIG. 2 is a cross section of an aperture framework made with framing elements 850. A plurality of sets of inflatable chambers 801 are connected by connector members 810. In this case the connector members pass through apertures and wrap more than 180 degrees around the connector members to reach adjacent inflatable chamber positioned on the lower side of the framework. The inflatable chambers overlap the framing elements and thereby serve each as an anchor for the other. The inflatable chambers at the ends of the string may be additionally held in place by connection to a pair of inflatable chambers that are positioned as shown in FIG. 1, by attaching a connector member at the end of the string to one of the framing members or by other positioning means for inflatable chambers as discussed elsewhere in these specifications.

Figure 3:
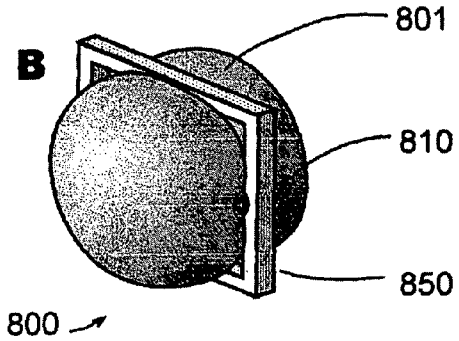
FIG. 3 shows a section through an aperture framework with three inflatable chambers connected through the apertures according to another embodiment of the present invention.
Figure 3:
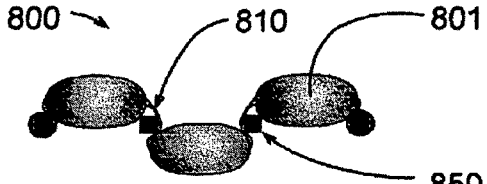

Referring now to FIG. 3, there is another balloon display using balloon buttons 800. FIG. 3 is a cross section of an aperture framework made with framing elements 850. A plurality of sets of inflatable chambers 801 are connected by connector members 810. In this case the connector members pass through but only about 90 degrees around the connector members to reach inflatable chamber positioned on the opposite side of the framework. The inflatable chambers overlap the framing elements and thereby serve each as an anchor for the other. The inflatable chambers at the ends of the string may be additionally held in place by connection to a pair of inflatable chambers that are positioned as shown in FIG. 1, by attaching a connector member at the end of the string to one of the framing members or by other positioning means for inflatable chambers as discussed elsewhere in these specifications.

Figure 4:
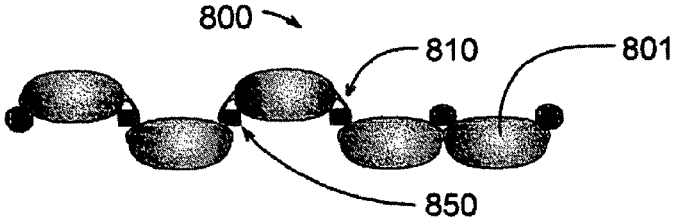
FIG. 4 shows a section through an aperture framework with five inflatable chambers connected through the apertures according to another embodiment of the present invention.

Referring now to FIG. 4, there is another balloon display using balloon buttons 800. FIG. 4 is a cross section of an aperture framework made with framing elements 850. A plurality of sets of inflatable chambers 801 are connected by connector members 810. In this case the connector members pass through but only about 90 degrees around the framing members to reach some inflatable chambers positioned on the opposite side of the framework. In this case some of the connector members pass through apertures and wrap more than 180 degrees around the framing members to reach adjacent inflatable chamber positioned on the lower side of the framework. The inflatable chambers overlap the framing elements and thereby serve each as an anchor for the other. The inflatable chambers at the ends of the string may be additionally held in place by connection to a pair of inflatable chambers that are positioned as shown in FIG. 1, by attaching a connector member at the end of the string to one of the framing members or by other positioning means for inflatable chambers as discussed elsewhere in these specifications.

Figure 5:
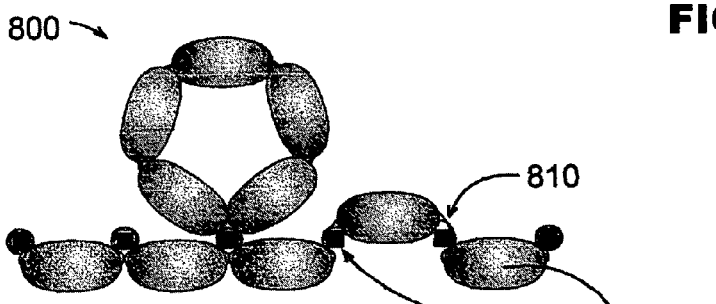
FIG. 5 shows a section through an aperture framework with ten inflatable chambers connected through the apertures according to another embodiment of the present invention.

Referring now to FIG. 5, there is another balloon display using balloon buttons 800. FIG. 5 is a cross section of an aperture framework made with framing elements 850. A plurality of sets of inflatable chambers 801 are connected by connector members 810. In this instance, not all inflatable chambers have contact with framing members. Some inflatable chambers are positioned as illustrated in FIGS. 2, 3, and 4. Other inflatable chambers in the string form a loop away from the framework and utilize the other inflatable chambers as an anchor to support the loop.

Figure 6:
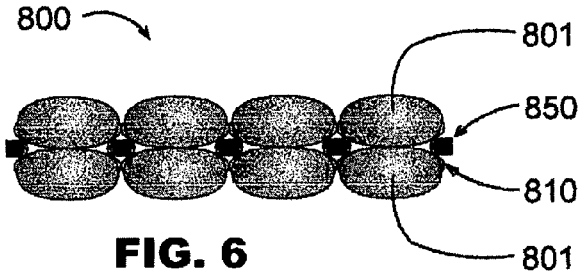
FIG. 6 shows a section through an aperture framework with eight inflatable chambers connected through the apertures according to another embodiment of the present invention.

Referring now to FIG. 6, there is another balloon display using balloon buttons 800. FIG. 6 is a cross section of an aperture framework made with framing elements 850. A plurality of sets of inflatable chambers 801 are connected by connector members 810. In this instance, there are inflatable chambers on both sides of the framework. Connector members pass through the apertures from one inflatable chamber that is sized and shaped to resist passing through an adjacent aperture to other inflatable chamber/s that are similarly sized and shaped to resist passing through an adjacent aperture. The uniform display shown here might be achieved by combinations of the various arrangements illustrated in FIGS. 1–5. When using a very flexible framework, the double sided display shown here contributes strength as well as graphic display.

Figure 7:
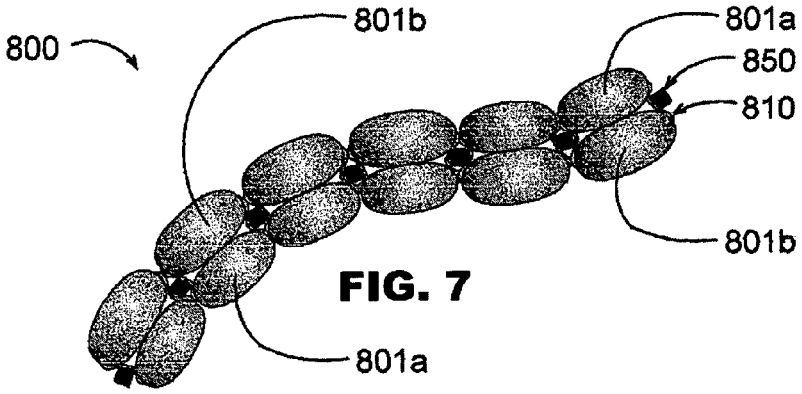
FIG. 7 shows a section through an aperture framework with twelve inflatable chambers connected through the apertures according to another embodiment of the present invention.

Referring now to FIG. 7, there is another balloon display using balloon buttons 800. FIG. 7 is a cross section of an aperture framework made with framing elements 850. A plurality of sets of inflatable chambers 801 are connected by connector members 810. In this instance, there are inflatable chambers on both sides of the framework. Connector members pass through the apertures from one inflatable chamber that is sized and shaped to resist passing through an adjacent aperture to other inflatable chamber/s that are similarly sized and shaped to resist passing through an adjacent aperture. In this case, however, some inflatable chambers are sized larger than others. In one area (toward the left end of the string) larger chambers 801*b* are on the upper side of the framework and smaller chambers 801*a* are on the lower side of the framework. In another area (toward the right end of the string) the smaller chambers 801*a* are on the upper side and larger chambers 801*b* are on the lower side. In each case the framework and string of chambers turn toward the smaller chambers. This approach offers means to control the shape of the display without necessity for rigid reinforcement.

Figure 8:
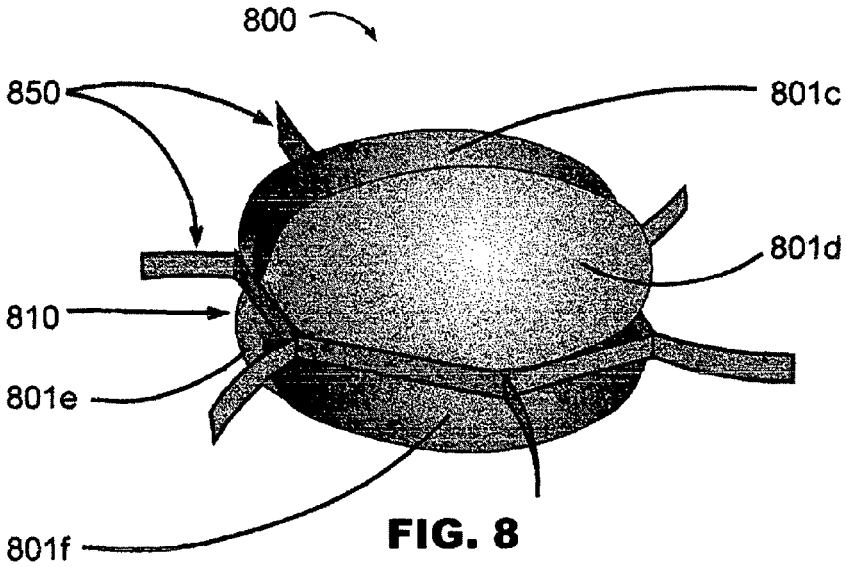
FIG. 8 shows perspective views illustrating one way to construct a balloon display with more than one inflatable chamber in a set on each side of an aperture framework with sets on opposite sides of the framework connected through the aperture according to the present invention.

Referring now to FIG. 8, there is another balloon display using balloon buttons 800. FIG. 8 is a cross section of an aperture framework made with framing elements 850. A plurality of sets of inflatable chambers 801 are connected by connector members 810. In this instance, there are inflatable chambers on both sides of the framework. Connector members pass through the apertures from one inflatable chamber that is sized and shaped to resist passing through an adjacent aperture to other inflatable chamber/s that are similarly sized and shaped to resist passing through an adjacent aperture. In this illustration the set of inflatable chambers on each side of the framework is a plurality of two with inflatable chambers 801*c* and 801*d* on the upper side and 801*e* and 801*f* on the lower side. Framing members 850 are cut out from a larger honeycomb pattern matrix. The framework apertures need not be hexagonal but might be any suitable shape matched to the end design sought and appropriate matching sizes and shapes of inflatable chambers.

E. Framework And Transmission Matrix

An expandable framework is produced by making patterns of overlapping cuts and seals in sheet material. The unexpanded framework is then combined with transmission devices and subsequently expanded into a predetermined matrix of framing material, transmission device/s and apertures. Various preferred embodiments of this Framework and Transmission Matrix deliver and/or display gas, liquids, solids, electricity, light, data, information and other useful content. Some preferred embodiments make use of the framework itself as the transmission device.

One preferred embodiment is a design developed for a FAT for holding and exploding balloons. A Overlapping Cut Expandable Matrix (OCEM) is configured with added slits or slots along the straps of the matrix to facilitate fastening electrical wires. The attached wires are connected at one end to a control device that allows electricity to pass through the wires on command. The other end of the wires are attached to a detonating devices that are in turn attached to inflated balloons within apertures of the matrix. When electricity is allowed through the wires, the detonating device is activated and balloons burst.

A similar preferred embodiment incorporates the same OCEM configuration but uses hollow tubing as the attached transmission device. The control mechanism allows pressurized fluid to pass through the hollow tube to activate a detonating device at the balloon end of the tube/s.

In another preferred embodiment, the attached electrical lines run to illumination devices. Depending upon the configuration of the matrix, the wiring combinations, configuration and placement of illumination devices attached to the matrix, and sophistication of control mechanism a large variety of lighting displays may be achieved.

In other preferred embodiments the OCEM may be configured of multiple layers of sheet material so that it has a hollow interior capable of transmitting fluids through its interior. Such a configuration might have small apertures strategically placed for the delivery of fluids. These fluids could be water or nutrient enriched water for distribution to grass, trees or other plants. These fluids could be pressurized gas for lifting or moving objects. These fluids could be gases for aerating liquids, stirring other fluids or fluidizing collections of objects.

In other preferred embodiments the fluids passing through the matrix may simply serve to heat or cool the surroundings or to absorb cooling or absorb heat from the surroundings. In similar fashion the matrix may be fitted with solar electric panels to collect solar energy and transmit it to a collection device.

In other preferred embodiments the hollow matrix may be used to hold gases such as neon that could be made to illuminate.

In other preferred embodiments the matrix may be made in part of material or coated with material that will conduct electricity rather than having wiring separately attached.

While devices exist for accomplishing many of these things, the OCEM form makes it easier to manufacture the distribution system in a relatively small space in a flat form that is readily and sometimes automatically expandable for end use.

Many other variations will be evident to those skilled in the various trades where the invention may be applied.

F. Structural Aperture System Balloon Display

Referring now to FIGS. 11A–B, there is an aperture framework balloon display incorporating a structural aperture system 1000. FIG. 11A shows a view perpendicular to the general plane of the major apertures of the framework comprised of framing members 1001. The framing members are arranged to form a pattern of square apertures 1004 and larger octagon apertures 1005. Within the framing members are minor apertures 1002 that are used to hold added structural members 1003 as desired by the designer. Two inflatable chambers 1010 are shown installed in octagon apertures. Square apertures may also be used to support inflatable chambers. Added structural members 1003 are shown in preferred locations immediately adjacent framing members 1001 and generally centered in the plane of the framework.

FIG. 11B shows the layout of the framework in FIG. 11A before the overlapping cut expandable framework is expanded.

Figure 12:
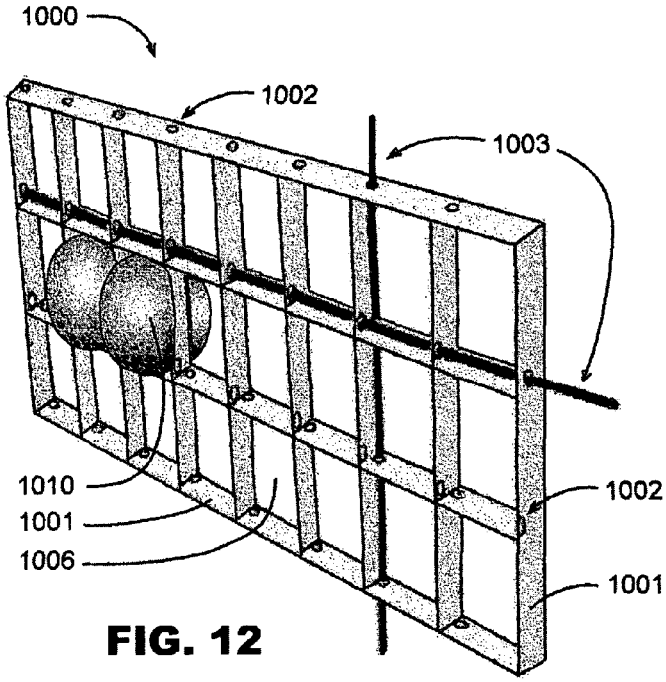
FIG. 12 shows a perspective view of a rectangular grid framework with small apertures in the walls of the larger apertures and added structural elements passing through the apertures.

Referring now to FIG. 12, there is an aperture framework balloon display incorporating a structural aperture system 1000. FIG. 12A shows a perspective view perpendicular of the major apertures of the framework comprised of framing members 1001. The framing members are arranged to form a pattern of rectangular apertures 1006. Within the framing members are minor apertures 1002 that are used to hold added structural members 1003 as desired by the designer. Two inflatable chambers 1010 are shown installed. Added structural members 1003 are shown in preferred locations immediately adjacent framing members 1001 and generally centered in the plane of the framework.

Figure 11:
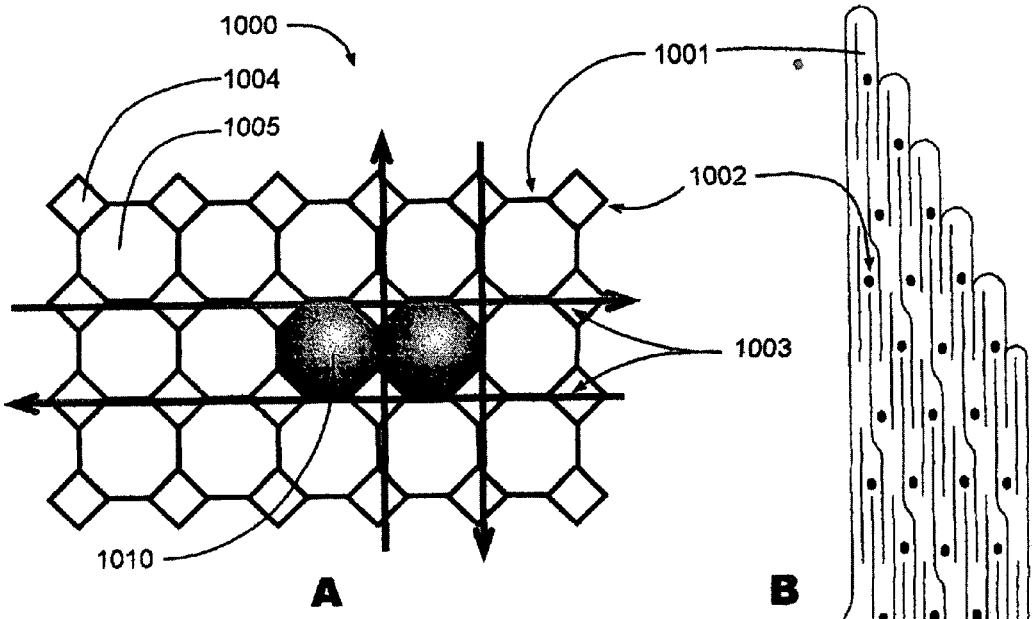
FIGS. 11A–B shows an expanded and an unexpanded view of an overlapping cut expandable matrix with small apertures in the walls of the larger apertures and added structural elements passing through the apertures.

While three aperture shapes are shown in FIGS. 11 and 12, many more are possible and encouraged. Two types of frameworks are shown but many more are possible and encouraged. These frameworks are shown with the plane of the framework generally flat, but many more shapes are possible and encouraged. Inflatable chambers are illustrated here as generally centered within the plane of the framework, but the designer need not be limited to this arrangement for the Structural Aperture System to be effective at reinforcing and shaping the balloon display. While inflatable chambers are shown here in preferred embodiments, other bulbous elements may be substituted for inflatable chambers to create effective displays.

What is claimed is:

1. A balloon display comprised of

A. At least one framework for supporting balloons wherein each said at least one framework is comprised of material surrounding at least one aperture and:

B. At least one first set of inflated chambers wherein:

i. Said at least one first set is comprised of at least one inflated chamber and;

ii. Said at least one first set is located adjacent an aperture in said at least one framework and;

iii. At least one dimension of said at least one first set is greater than an adjacent and parallel dimension of said adjacent aperture and;

C. At least one additional set of inflated chambers wherein:

i. Said at least one additional set is comprised of at least one inflated chamber and;

ii. Said at least one additional set is located adjacent an aperture in said at least one framework and;

iii. At least one dimension of said at least one additional set is greater than an adjacent and parallel dimension of said adjacent aperture and;

D. At least one first connection/s between said at least one first set and said at least one additional set of inflated chambers wherein said at least one first connection/s pass/es through said aperture adjacent said at least one first set of inflated chambers and;

E. At least one additional connection/s between said at least one first set and said at least one additional set of inflated chambers wherein i. said at least one additional connection/s pass/es through an aperture adjacent said at least one first set of inflated chambers and ii. at least one of said at least one first connection/s and at least one of said at least one additional connection/s do not touch each other.

2. A balloon display as described in claim 1 wherein said at least one framework is comprised of a plurality of frameworks.

3. A balloon display as described in claim 1 wherein said at least one framework is comprised of material surrounding a plurality of apertures.

4. A balloon display as described in claim 1 wherein said at least one first set of inflated chambers is comprised of a plurality of inflated chambers.

5. A balloon display as described in claim 1 wherein said at least one first set of inflated chambers is comprised of a plurality of sets of inflated chambers.

6. A balloon display as described in claim 1 wherein said at least one additional set of inflated chambers is comprised of a plurality of inflated chambers.

7. A balloon display as described in claim 1 wherein said at least one additional set of inflated chambers is comprised of a plurality of sets of inflated chambers.

8. A balloon display as described in claim 1 wherein said at least one additional set of inflated chambers has its center of mass on a different side of said at least one framework as said at least one first set of inflatable chambers.

9. A balloon display as described in claim 1 wherein said at least one additional set of inflated chambers has its center of mass on the same side of said at least one framework as said at least one first set of inflatable chambers.

10. A balloon display as described in claim 1 wherein at least one of said at least one additional set of inflatable chambers and at least on of said at least one first set of inflatable chambers and at least one connection between them are formed of the same continuous material.

11. A balloon display as described in claim 1 wherein there is fluid communication between a plurality of inflated chambers.

12. A balloon display as described in claim 1 wherein there is no fluid communication between a plurality of inflated chambers.

13. A balloon display as described in claim 1 wherein said at least one framework is an overlapping cut expandable matrix.

14. A balloon display as described in claim 1 wherein said inflated chambers are a continuous balloon structure.

* * * * *